US009103217B2

(12) United States Patent
Giglio et al.

(10) Patent No.: US 9,103,217 B2
(45) Date of Patent: Aug. 11, 2015

(54) TURBINE BLADE TIP WITH TIP SHELF DIFFUSER HOLES

(71) Applicant: General Electric Company, Schenectady, NY (US)

(72) Inventors: Anthony Louis Giglio, Simpsonville, SC (US); Camilo Andres Sampayo, Greer, SC (US); Michael J. Kline, Marietta, GA (US)

(73) Assignee: General Electric Company, Schenectady, NY (US)

( * ) Notice: Subject to any disclaimer, the term of this patent is extended or adjusted under 35 U.S.C. 154(b) by 644 days.

(21) Appl. No.: 13/664,503

(22) Filed: Oct. 31, 2012

(65) Prior Publication Data

US 2014/0271226 A1 Sep. 18, 2014

(51) Int. Cl.
*F01D 5/18* (2006.01)
*F01D 5/20* (2006.01)

(52) U.S. Cl.
CPC ..... *F01D 5/186* (2013.01); *F01D 5/187* (2013.01); *F01D 5/20* (2013.01); *F05D 2260/202* (2013.01)

(58) Field of Classification Search
CPC ..... F01D 5/12; F01D 5/18; F01D 5/186; F01D 5/187; F01D 5/20; F01D 5/225; F01D 25/12; F05D 2240/307; F05D 2260/201; F05D 2260/202
See application file for complete search history.

(56) References Cited

U.S. PATENT DOCUMENTS 4,142,824 A 3/1979 Andersen
4,606,701 A * 8/1986 McClay et al. ..... 416/92
4,893,987 A * 1/1990 Lee et al. ..... 416/92
5,183,385 A * 2/1993 Lee et al. ..... 416/97 R
5,261,789 A 11/1993 Butts et al.
5,564,902 A 10/1996 Tomita
6,190,129 B1 * 2/2001 Mayer et al. ..... 416/97 R
6,224,336 B1 * 5/2001 Kercher ..... 416/97 R
6,554,575 B2 * 4/2003 Leeke et al. ..... 416/224
6,602,052 B2 8/2003 Liang
6,932,571 B2 * 8/2005 Cunha et al. ..... 416/97 R
6,994,514 B2 * 2/2006 Soechting et al. ..... 415/115
7,097,419 B2 * 8/2006 Lee et al. ..... 415/115
7,118,337 B2 * 10/2006 Liang ..... 416/1
7,473,073 B1 1/2009 Liang
7,510,376 B2 * 3/2009 Lee et al. ..... 416/97 R
7,704,045 B1 4/2010 Liang (Continued)

FOREIGN PATENT DOCUMENTS

EP 1059419 A1 12/2000
EP 1298285 A2 4/2003

(Continued)

OTHER PUBLICATIONS

EP Search and Examination Report dated Feb. 10, 2014, issued in connection with corresponding EP Application No. 13190436.9.

*Primary Examiner* — Edward Look
*Assistant Examiner* — Christopher R Legendre
(74) *Attorney, Agent, or Firm* — Ernest G. Cusick; Frank A. Landgraff

(57) ABSTRACT

A turbine blade having a tip including a tip shelf through which pass one or more diffuser cooling holes, the diffuser cooling holes directing the flow of cooling gas along the tip shelf, spreading the flow of cooling gas more evenly along the tip shelf and enhancing the formation of a curtain of cooling air along the tip shelf, leading to lower blade tip temperatures, reduced diversion of cooling air, and greater turbine blade life.

13 Claims, 4 Drawing Sheets

(56) References Cited

U.S. PATENT DOCUMENTS

| | | | | |
|---|---|---|---|---|
| 7,857,587 | B2 * | 12/2010 | Correia et al. | 416/92 |
| 8,628,299 | B2 * | 1/2014 | Ammann et al. | 416/97 R |
| 2004/0179940 | A1 | 9/2004 | Liang | |
| 2004/0197190 | A1 | 10/2004 | Stec et al. | |
| 2011/0255990 | A1 * | 10/2011 | Diamond et al. | 416/97 R |
| 2012/0189427 | A1 * | 7/2012 | Kwon et al. | 415/1 |
| 2013/0243596 | A1 * | 9/2013 | Quach | 416/92 |
| 2014/0271226 | A1 * | 9/2014 | Giglio et al. | 416/97 R |

FOREIGN PATENT DOCUMENTS

| | | | |
|---|---|---|---|
| EP | 1422383 | A2 | 5/2004 |
| EP | 1445424 | A2 | 8/2004 |
| EP | 1762701 | A2 | 3/2007 |
| EP | 2469030 | A2 | 6/2012 |
| WO | 2013180797 | A2 | 12/2013 |

* cited by examiner

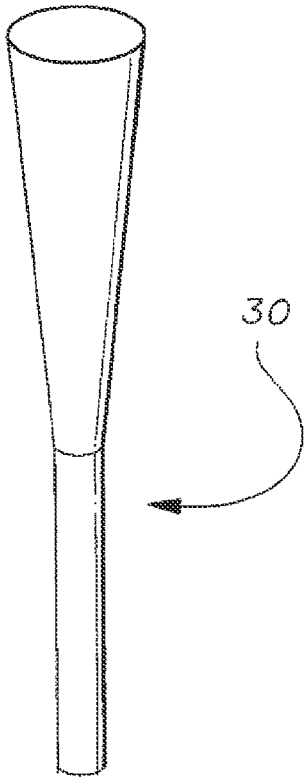
Fig. 7
Fig. 8
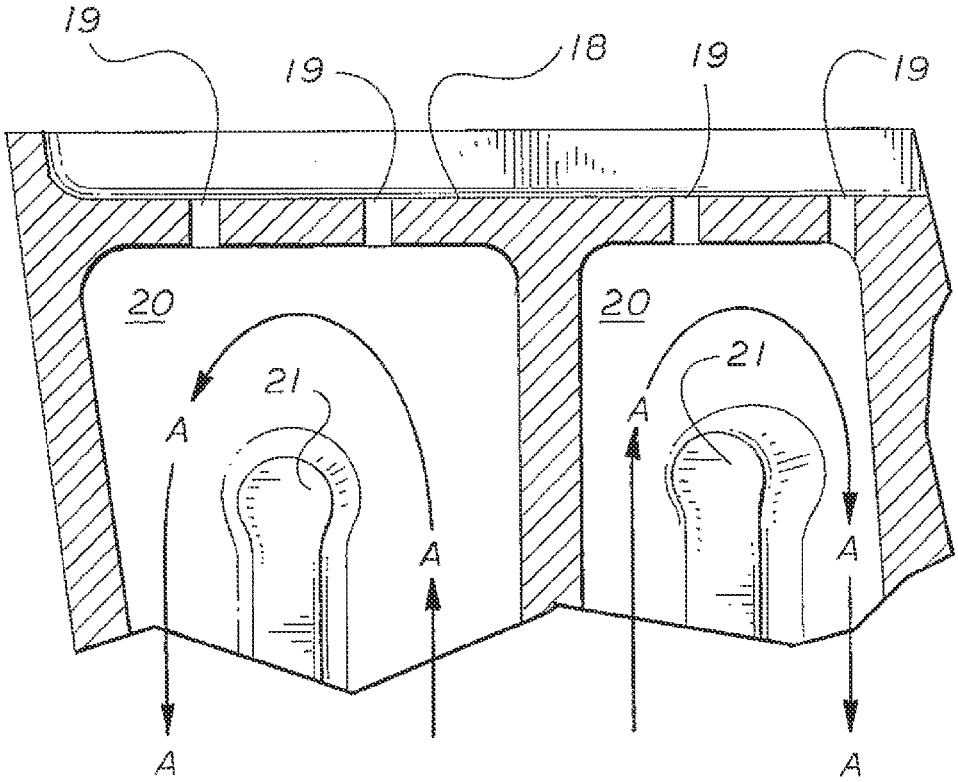

TURBINE BLADE TIP WITH TIP SHELF DIFFUSER HOLES

TECHNICAL FIELD

The present disclosure relates generally to gas turbine engines, and, more specifically, to a gas turbine engine rotor blade having improved tip cooling.

BACKGROUND OF THE INVENTION

A gas turbine engine includes one or more turbine blade rows disposed downstream of a combustor which extracts energy from combustion gases generated by the combustor. Disposed radially outwardly of the rotor blade tips may be a stator shroud which is spaced from the blade tips to provide a relatively small clearance between the blade tips and shroud for reducing leakage of the combustion gases over the blade tips during operation. Each of the rotor blades includes conventionally known pressure and suction sides which are preferentially aerodynamically contoured for extracting as much energy as possible from the combustion gases flowing over the rotor blades. The pressure and suction sides extend to the blade tip and are disposed as close as possible to the stator shroud for maximizing the amount of energy extracted from the combustion gases. The clearance, however, between the blade tips and the stator shroud must nevertheless be adequate to minimize the occurrence of blade tip rubs during operation, which may damage the blade tips.

Un-shrouded blades use a squealer tip to reduce hot gas leakage over the blade tip and reduce performance penalties. Such a tip design typically requires ribs, generally a pressure side rib and a suction side rib, to protrude from the blade tip floor. These ribs are relatively thin, which makes them difficult to cool effectively through conduction. Turbine blade tips and associated ribs, moreover, are exposed to the very high temperatures of combustion gasses flowing over their outside surfaces. These high temperatures and low cooling effectiveness lead to durability issues on the tip ribs and the potential for blade fallout at the end of the blade's life interval. Any tip ribs that suffer oxidation or cracks beyond the squealer floor will render a blade irreparable regardless of the overall airfoil condition.

Whether shrouded or un-shrouded, turbine rotor blades are typically hollow for channeling cooling air through the interior of the blade. This cooling air is provided from a conventional compressor of the gas turbine engine to cool the blades from the heat flux generated by the combustion gases flowing over the blades. The tip, or tip cap, portion of the blades is particularly susceptible to the damaging effects of the hot combustion gases and must be suitably cooled for reducing blade tip distress in the form of oxidation and thermal fatigue during operation. As the blade tip erodes during operation due to the blade tip distress, the pressure and/or suction sides of the blade are adversely affected, which decreases the aerodynamic efficiency of the blade used for extracting energy from the combustion gases. In addition, such erosion of the blade tip also increases the clearance between the blade tip and the stator shroud, which allows more of the combustion gases to leak over the blade tip, and, therefore, extraction of the energy therefrom is lost which also decreases aerodynamic efficiency.

Numerous conventional blade tip cap designs exist for maintaining the proper pressure and suction side flow surfaces of the blade at the tip cap as well as providing minimum clearances with the stator shroud. Numerous cooling configurations also exist for cooling the blade tips or blade tip caps for meeting life requirements of the blades without undesirable erosion thereof. Conventional design practice makes use of a tip shelf recess or an L-shaped trough defined by the tip shelf and a first tip wall disposed on the pressure side of the blade. The tip shelf may offer the advantage of providing a discontinuity on the airfoil pressure side of the blade tip, causing combustion gasses to separate from the surface of the blade tip, which may decreases the heat transfer capability of the hot gasses to the blade tip, and therefore may decrease the heat flux into the blade tip. Conventional design practice also makes use of straight round holes through the tip shelf for passing cooling gas from the hollow blade interior to the tip shelf and pressure side rib, with resultant tip cooling due to convective and film effects. The tip shelf recess provides a region for the cooling air exiting the interior of the blade to accumulate, thereby providing a film blanket of cooling air between the hot combustion gasses and the blade tip, thereby further cooling the blade tip.

Another approach to cooling the blade tip is to increase the total number of straight round cooling holes in the tip shelf to increase the total cooling flow and decrease the space available for hot gas to interact with the surface. Since cooling of the blade, including the blade tip, uses a portion of the compressed air from the gas turbine compressor, however, that air is unavailable for combustion in the combustor of the engine which decreases the overall efficiency of the gas turbine engine. Accordingly, cooling of the blade, including the blade tip, should be accomplished with as little compressed air as possible to minimize the loss in gas turbine engine efficiency.

Still another approach involves creating channels or indentations in the pressure side rib to direct cooling flow from the pressure side tip holes over the rim at desired locations to better cover the surface.

Yet another approach is to thicken the pressure side rim and drill cooling holes through the center and exit at the rim top face. It would be desirable to provide tip shelf cooling holes that are economical to install, provide an acceptable flow of cooling air over the blade tip shelf, and provide an improved film blanket of cooling air spread across the tip shelf, thereby better protecting the blade tip from hot combustion gasses.

BRIEF DESCRIPTION OF THE INVENTION

According to the present disclosure, one or more diffuser cooling holes may be provided in the tip shelf of a turbine blade assembly. Diffuser cooling holes may allow the cooling gas to begin diffusing before exiting the cooling hole and covering a larger area than a straight hole would provide. The diffused cooling gas may then flow over the pressure side rail covering a larger surface area than is typical using straight round cooling holes. This increased coverage may provide more even cooling to the pressure side rail and less near-surface leakage paths for hot gas to occupy. The cooling gas diffusion also may serve to reduce the coolant exit velocity into the tip shelf cavity. The reduced velocity may increase the amount of cooling gas that is entrained in the shelf, thereby enhancing the overall cooling into the pressure side rail from the tip shelf region.

BRIEF DESCRIPTION OF THE DRAWINGS

The following description is better understood when read in conjunction with the appended drawings.

FIG. 7 is a perspective view of a tool body used for cutting a diffuser hole of an embodiment of the present disclosure.

FIG. 8 is a partial cross sectional view of a portion of the tip portion of a gas turbine engine blade embodiment of the disclosure.

Gas turbine blades having a cooling channel therein for channeling cooling air to the tip of the blade are generally known. As is known, the turbine blades typically include an airfoil including a first side joined to a second side at spaced apart leading and trailing edges to define therein a flow channel for channeling cooling air through the airfoil to cool the airfoil from combustion gases flowing over the first and second sides. The airfoil typically has a tip at its distal end and a root having a dovetail extending from the root for mounting the blade to a rotor disk. The airfoil tip typically includes a tip floor extending between the airfoil first and second sides and between the leading and trailing edges for enclosing the airfoil for containing cooling air in the air flow channel. A first tip wall typically extends from the tip floor at the airfoil first side to form an extension thereof. A second tip wall typically extends from the tip floor at the airfoil second side to form an extension thereof, and is spaced in part from the first tip wall to define therebetween an outwardly facing tip plenum. The first tip wall is typically recessed at least in part from the airfoil first side to define an outwardly facing tip shelf extending between the leading and trailing edges to provide a discontinuity in the airfoil first side, the first tip wall and the tip shelf defining therebetween a tip shelf recess or trough. In an alternative form, the tip shelf may extend from the leading edge to a point short of the trailing edge, a configuration sometimes referred to as a "partial tip shelf"

Figure 1:
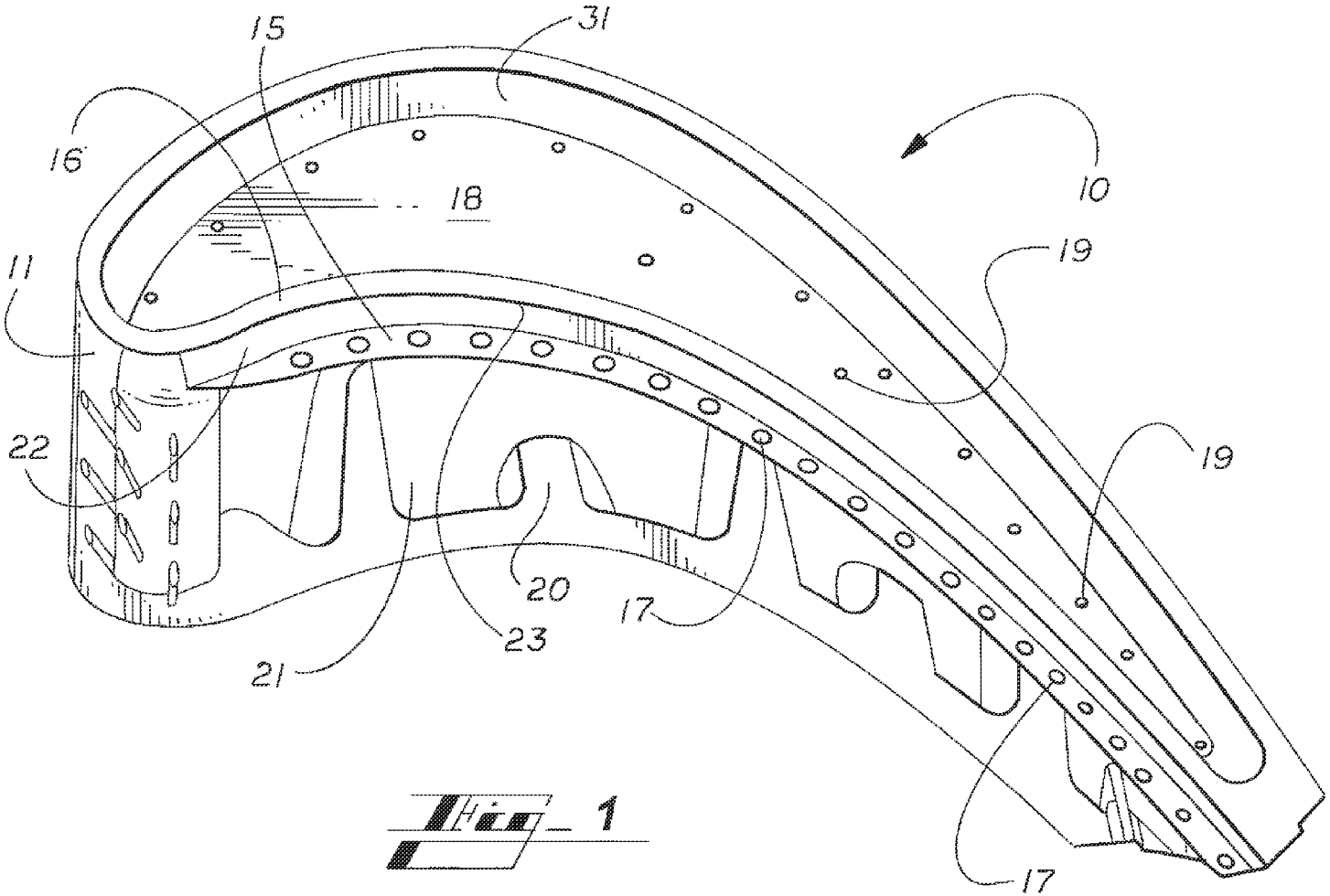
FIG. 1 is a schematic, perspective, partly sectional view of the tip portion of a gas turbine engine blade embodiment of the disclosure.
Figure 2:
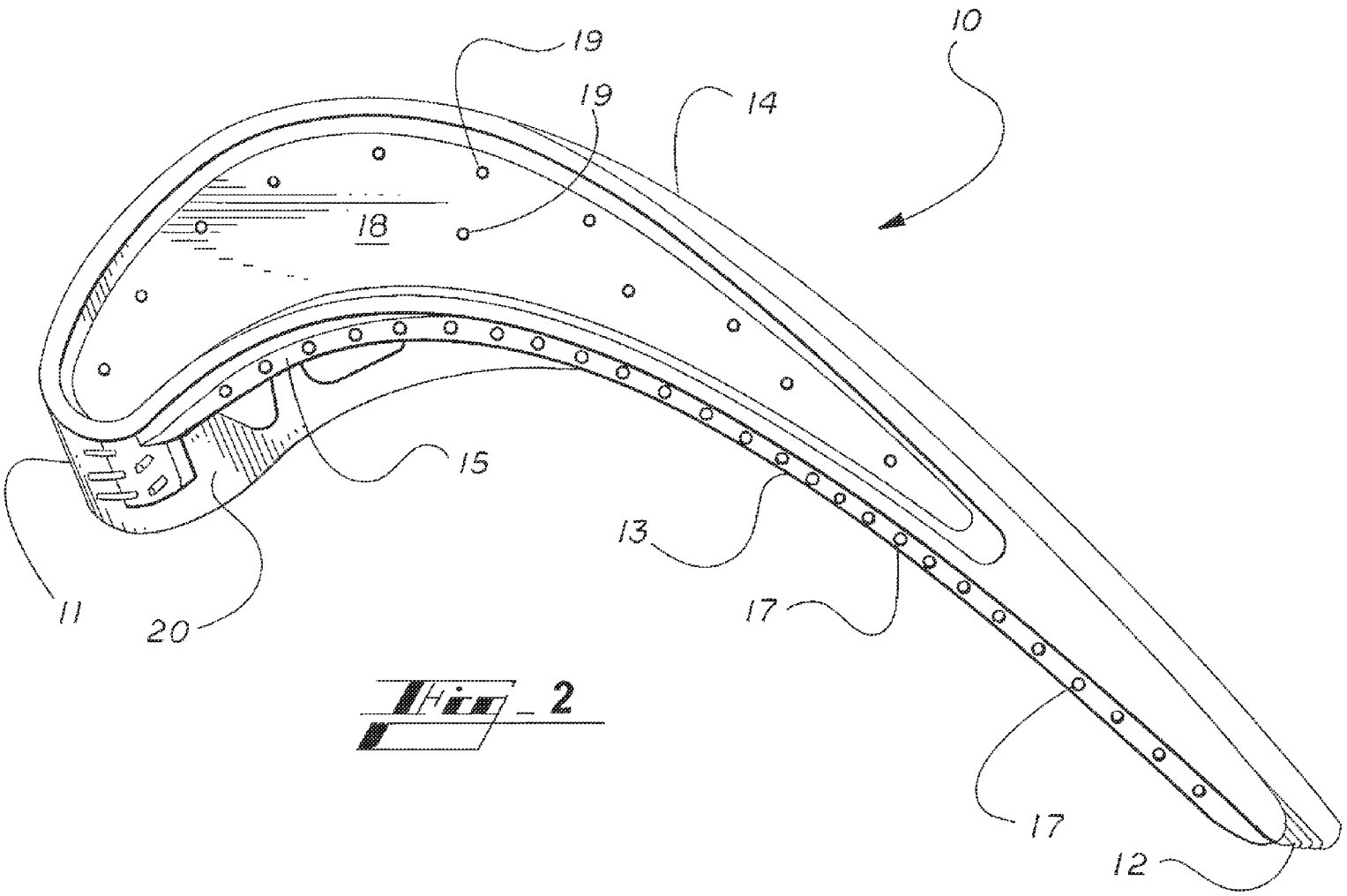
FIG. 2 is a top plan view of the tip portion of FIG. 1.

Referring to FIGS. 1, 2, and 8, there is shown a portion of a turbine blade squealer tip, generally 10, of an embodiment of the present disclosure. The squealer tip 10 may be located at the distal end of a turbine blade assembly. The turbine blade assembly may have at its proximal end an airfoil root for mounting the blade to a rotor disc of a gas turbine engine. The blade assembly and squealer tip 10 may have along their length between the airfoil root and the blade tip a leading edge 11 that may transition to a tapered trailing edge 12. The blade assembly and squealer tip further may have along its width between the leading edge 11 and trailing edge 12 a first wall 13 on the pressure side of the assembly, and a second wall 14 on the suction side of the assembly opposite the first wall 13. The first wall 13 may have a generally concave shape and may have disposed thereon a tip shelf, sometimes referred to as a butt shelf or bucket tip shelf, 15, that may run substantially from the leading edge 11 to the trailing edge 12. The second wall 14 may have a substantially convex shape.

As illustrated, the tip shelf 15 may be formed in a squealer tip rim 16 that is positioned at the blade tip. The tip shelf 15 may have positioned therealong one or more diffuser cooling holes 17. As further illustrated, the tip floor or plenum, generally 18, may include one or more tip floor cooling holes 19 distributed thereon. These diffuser cooling holes 17 and tip floor cooling holes 19 may be in flow communication with a substantially hollow interior 20 of the blade assembly, which may include a serpentine flow channel configuration formed by one or more internal ribs 21 for channeling cooling air, represented by the arrows "A" in FIG. 8, through the hollow interior 20 of the blade in order to cool it. The cooling air may be provided by a compressor (not shown) of the gas turbine and is conventionally channeled through the rotor disk into the blade. The tip shelf 15 may include an L-shaped tip trough or tip shelf recess 22 formed by the tip shelf 15 and the first vertical tip wall 23, which may be, but is not always, generally vertical and perpendicular to the tip shelf 15. In other embodiments, the tip wall 23 may be angled, i.e., non-perpendicular, relative to the tip shelf 15. A second vertical tip wall 31 is spaced apart from the first vertical tip wall 23 on the suction side of the blade tip, with the tip floor 18 being formed therebetween. While the embodiment illustrated in FIG. 1 includes a second vertical tip wall 31 that may be generally perpendicular to the tip floor 18, this may not always be the case, and the second tip wall 31 may in some embodiments be angled, i.e., non-perpendicular, relative to the tip floor 18.

Figure 3:
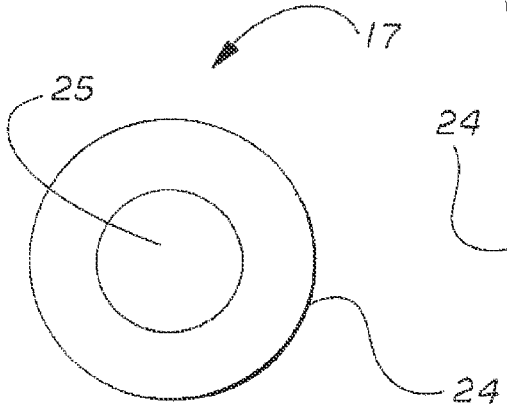
FIG. 3 is a top plan view of a diffuser cooling hole of an embodiment of the present disclosure.
Figure 4:
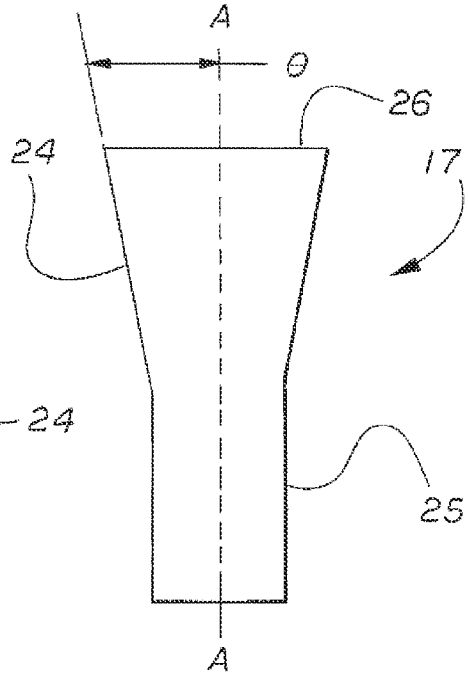
FIG. 4 is a side cross sectional view of the diffuser cooling hole of FIG. 3.

As more particularly shown in FIGS. 3 and 4, the diffuser cooling holes 17 of an embodiment of the present disclosure may have a diffuser portion 24 therein that is configured to diffuse cooling air as it exits the diffuser cooling hole 17. Such diffuser portion 24 may flare outwardly from the longitudinal axis AA of the diffuser cooling hole 17 as shown in FIG. 4, and may comprise the entire perimeter or circumference of the diffuser portion 24 as illustrated in FIG. 3. The diffuser cooling holes 17 may further include a generally straight (cylindrical in the axial direction) round cross section portion 25 as illustrated in FIG. 4 that may communicate with the hollow interior 20 of the turbine blade tip, and may receive the cooling gas therefrom.

As used herein, the term "diffuser cooling hole" is intended to mean a cooling hole that tends to diffuse and/or reduce the flow rate of cooling gas at the point where the cooling gas exits the cooling hole, as distinguished from fully straight-walled or cylindrical cooling holes, which do not perform in this manner. In one embodiment of the disclosure, the diffuser portion 24 may flare generally outwardly relative to the longitudinal axis AA of the diffuser cooling hole 17, and may be generally conical in shape in the axial direction and round in cross section, although other configurations for the diffuser portion 24, including, without limitation, parabolic, hyperbolic, semi-circular, semi-elliptical, and/or semi-oval, for example, in the axial direction, and elliptical, oval, square, rectangular, and/or round, for example, in cross section, are also possible, provided the configuration tends to have an exit 26 with a greater area than a cross sectional area of the diffuser portion upstream of the exit, and tends to diffuse and/or reduce the flow rate of the cooling gas at the point 26 it exits the tip shelf, and tends to create a curtain of cooling gas along the tip shelf recess 22. It is also possible for the diffuser portion 24 of the diffuser cooling holes 17 to extend only a portion of the way around the cooling hole perimeter, e.g., in the case of a round diffuser in cross section, the diffuser portion 24 may extend 180° around the circumference, being half conical, for example, and half cylindrical, thereby creating a one-sided diffuser. As illustrated in FIG. 4, the diffuser portion 24 may flare outwardly relative to the longitudinal axis AA of the diffuser cooling hole 17 by an angle θ of about 0°-20°, and even more specifically about 5°, although other angles are of course possible. If, however, the angle θ is too low, the diffuser cooling hole may behave virtually like a straight sided cylindrical hole, and if the angle θ is much beyond the highest value of the range indicated, flow separation may occur, resulting in a loss of diffusion and a decrease in cooling effectiveness.

Figure 5:
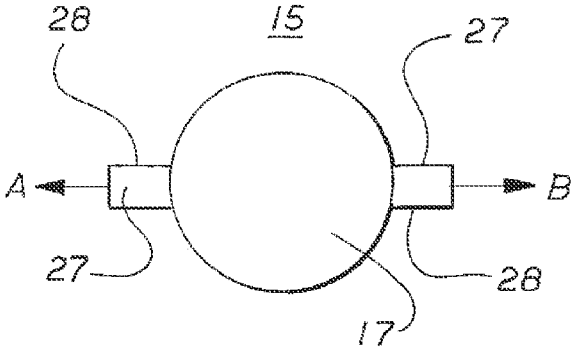
FIG. 5 is a top plan view of the diffuser portion of a cooling hole according to another embodiment of the present disclosure.
Figure 6:
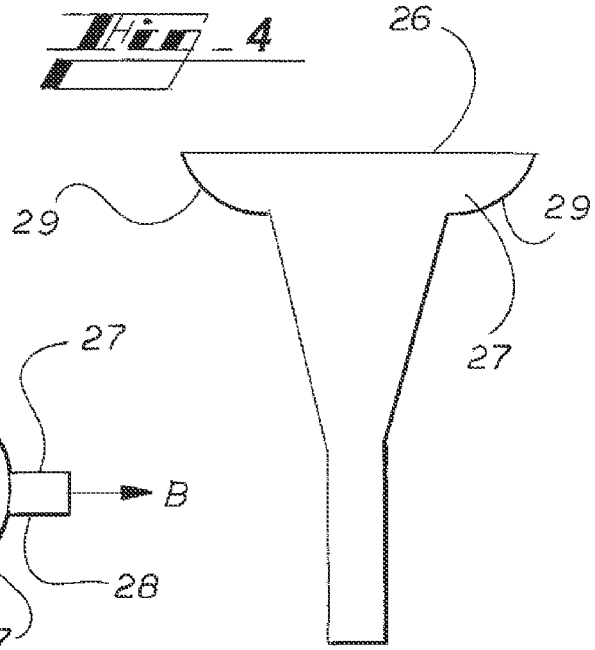
FIG. 6 is a side cross sectional view of the cooling hole of FIG. 5.

By way of further example, as illustrated in FIGS. 5 and 6, one or more of the diffuser cooling holes 17 may be slotted at the point of exit 26 along the tip shelf 15, with one or more slots 27 on the side of the diffuser cooling hole 17 positioned generally parallel to the longitudinal direction of the tip shelf recess 22, i.e., directing cooling air forward as illustrated by arrow A and/or aft as illustrated by arrow B along the tip shelf 15. Additional slots 27 may be positioned around the diffuser cooling hole(s) 17 to direct cooling air in other directions. When such slots 27 are used, the diffuser cooling holes 17 may be either straight or diffused in the axial direction. Although the slots 27 are shown as straight with parallel sides 28 and arcuate bases 29, the slots 27 may have converging or diverging sides 28, curved sides 28, or other configurations, and may have a straight base 29 or other configurations as will now be appreciated by those of ordinary skill in the art. In another embodiment, the diffuser cooling holes 17 illustrated in FIGS. 5 and 6 may be connected to at least one other similar cooling hole 17 by extending neighboring slots 27 of each diffuser cooling hole 17 until they join to form one slot connecting the two neighboring diffuser cooling holes 17.

As will now be appreciated, by varying the size and/or shape of the diffuser cooling holes 17 arrayed along the tip shelf 15, it may be possible to vary the flow rate and coverage of cooling gas in different regions of the tip shelf 15 with the objective of equalizing the temperature profile across the turbine tip. The flow rate is controlled by the size of the straight round portion 25 of the diffuser cooling holes 17. By increasing the size of the straight round portion 25, higher flow rates can be delivered to regions known to experience higher temperatures and vice versa. The diffuser portion 24 controls the spread and exit velocity of the flow. For a given flowrate, (i.e. fixed straight round portion 25), the diffuser portion 24 can be adjusted to tune the local temperatures. By making the diffuser portion 24 larger, the flow is spread out over a larger area providing better film coverage in regions known to experience higher temperatures. If the diffuser portion 24 is made smaller to approach the size and shape of the straight round portion 25, then the cooling benefits of the diffuser design are lessened.

Illustrated in FIG. 7 is a perspective view of a cutting tool generally 30 that may be used to drill and/or punch diffuser cooling holes 17 having substantially the same shape as the tool 30 in the tip shelf 15 using methods known to those of ordinary skill in the art.

The disclosure may help to enhance film coverage over the pressure side tip rim, thereby reducing temperature gradients which are detrimental to LCF life. The disclosure may also help to distribute cooling air more evenly to the pressure side tip rim, thereby reducing overall surface temperatures. The use of diffuser shaped holes according to the present disclosure can lead to lower cooling flow usage relative to round straight holes for the same temperature limits, or equal cooling flow usage relative to round straight holes with decreased temperatures.

This written description uses examples to disclose the various embodiments, including the best mode, and also to enable any person of ordinary skill in the art to practice the disclosure, including making and using any devices or systems and performing any incorporated methods or apparatus. The patentable scope of the disclosure is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

What is claimed:

1. A gas turbine engine blade comprising:

an airfoil including a first side joined to a second side at spaced apart leading and trailing edges to define therein a flow channel for channeling cooling air through said airfoil to cool said airfoil from combustion gases flowable over said first side and second side, said airfoil having a tip;

said tip comprising:

a tip floor extending between said first side and second side and between said leading and trailing edges for enclosing said airfoil for containing said cooling air in said flow channel;

a first tip wall extending from said tip floor at said airfoil first side to form an extension thereof;

a second tip wall extending from said tip floor at said airfoil second side to form an extension thereof and spaced in part from said first tip wall to define therebetween an outwardly facing tip plenum;

said first tip wall being recessed at least in part from said airfoil first side to define an outwardly facing tip shelf extending between said leading and trailing edges to provide a discontinuity in said airfoil first side, said first tip wall and said outwardly facing tip shelf defining therebetween a trough; and a plurality of diffuser cooling holes extending through said tip shelf in flow communication between said flow channel and said trough for channeling a portion of said cooling air into said trough for cooling said tip, wherein said plurality of diffuser cooling holes comprise a diffuser portion comprising a generally conical shape comprising side walls that flare outwardly at an angle relative to a longitudinal axis of said diffuser cooling holes and wherein said plurality of diffuser cooling holes further comprise a generally straight section in flow communication with said flow channel for channeling cooling air and wherein said plurality of diffuser cooling holes comprise a pair of slots in said diffuser portion, one said slot extending along said tip shelf in a substantially forward direction and the other said slot extending along said tip shelf in a substantially aft direction along said tip shelf.

2. The gas turbine engine blade of claim 1 wherein each diffuser portion is in flow communication with said trough and has a shape that is at least partially one of conical, parabolic, hyperbolic, semi-circular, semi-elliptical, and semi-oval in the axial direction of said diffuser cooling hole.

3. The gas turbine engine blade of claim 1 wherein one of said plurality of diffuser cooling holes comprises a different size and/or shape relative to the other of said plurality of diffuser cooling holes, thereby providing different flow rates of cooling gas in different regions of the tip.

4. The gas turbine engine blade of claim 1 wherein at least two of said plurality of diffuser cooling holes are connected to each other by one of said slots from one said diffuser cooling hole being joined to one of said slots from an adjacent diffuser cooling hole.

5. A turbine blade assembly, said turbine blade assembly comprising a blade tip at one end thereof, said blade assembly further comprising a length having therealong a leading edge transitioning to a trailing edge, said blade assembly further comprising a width having therealong between said leading edge and said trailing edge a first wall comprising a pressure side, said blade assembly further comprising along its width a second wall opposite said first wall comprising a suction side, said blade assembly further comprising along its width proximate said blade tip a tip shelf, said blade assembly further comprising a substantially hollow interior adapted to receive therethrough a cooling gas, said tip shelf comprising at least one diffuser cooling hole disposed therein in flow communication with said substantially hollow interior, wherein said at least one diffuser cooling hole comprises a diffuser portion shaped to diffuse cooling gas exiting said cooling hole and wherein at least a portion of said diffuser portion comprises at least one slot extending radially from said diffuser portion.

6. The turbine blade assembly of claim 5 wherein said tip shelf is formed in a squealer tip rim positioned at said blade tip.

7. The turbine blade assembly of claim 5 wherein said at least one diffuser cooling hole comprises a generally straight section in flow communication with said substantially hollow interior and a generally outwardly flaring portion in flow communication with said tip shelf.

8. The turbine blade assembly of claim 7 wherein said generally outwardly flaring portion comprises an entire circumference of said diffuser portion and comprises a shape in its axial direction that is generally one of conical, parabolic, hyperbolic, semi-circular, semi-elliptical, and semi-oval.

9. The turbine blade assembly of claim 5 wherein said at least one slot comprises a first slot and a second slot, the first slot oriented in a generally forward direction along said tip shelf and the second slot oriented in a generally aft direction along said tip shelf.

10. A turbine blade assembly comprising a tip shelf, said tip shelf having disposed therein at least one diffuser cooling hole, wherein said at least one diffuser cooling hole comprises a diffuser portion shaped to diffuse cooling gas exiting said diffuser cooling hole and said diffuser portion comprising at least a portion thereof having an outwardly flaring section relative to a longitudinal axis of said diffuser cooling hole, and wherein said outwardly flaring section comprises at least one slot extending radially from said diffuser portion.

11. The turbine blade assembly of claim 10 wherein said at least one diffuser cooling hole comprises a generally straight portion with a first end in flow communication with a substantially hollow interior portion of said turbine blade assembly, and a second end in flow communication with said diffuser portion.

12. The turbine blade assembly of claim 10 wherein said outwardly flaring section is configured to have a flow exit with a larger area than a cross sectional area of the diffuser portion upstream of the flow exit.

13. The turbine blade assembly of claim 10 wherein said outwardly flaring section comprises an entire circumference of said diffuser portion.

* * * * *